US006026530A

United States Patent [19]

Camp, Jr.

[11] Patent Number: 6,026,530

[45] Date of Patent: Feb. 22, 2000

[54] CAM-SHAPED ROLLER MOP

[75] Inventor: William P. Camp, Jr., Wooster, Ohio

[73] Assignee: Rubbermaid Incorporated, Wooster, Ohio

[21] Appl. No.: 09/085,373

[22] Filed: May 26, 1998

[51] Int. Cl.[7] ..... A47L 13/12; A47L 13/144

[52] U.S. Cl. ..... 15/119.2; 15/121; 15/245

[58] Field of Search ..... 15/116.1, 116.2, 15/119.1, 119.2, 121, 245

[56] References Cited

U.S. PATENT DOCUMENTS

| | | | |
|---|---|---|---|
| D. 280,769 | 9/1985 | Johnson et al. | D32/44 |
| 2,203,106 | 6/1940 | Rogers | 15/119.2 |
| 2,221,557 | 11/1940 | Rogers | 15/119.2 |
| 2,235,264 | 3/1941 | Rogers | 15/119.2 |
| 2,852,794 | 9/1958 | Blum | 15/119 |
| 3,008,163 | 11/1961 | Bommer | 15/119 |
| 3,037,229 | 6/1962 | Anderson | 15/119 |
| 4,196,488 | 4/1980 | Barry | 15/119 A |
| 4,464,807 | 8/1984 | Weiss | 15/119 A |
| 4,491,998 | 1/1985 | Wilson et al. | 15/119 A |
| 4,604,767 | 8/1986 | Burkhart et al. | 15/119 A |
| 4,777,690 | 10/1988 | Ancier | 15/119 A |
| 4,856,835 | 8/1989 | Pacione | 294/61 |
| 4,893,369 | 1/1990 | Johnson | 15/119 A |
| 5,606,760 | 3/1997 | De Guzman | 15/119.2 |
| 5,655,248 | 8/1997 | Kieson et al. | 15/119.2 |

FOREIGN PATENT DOCUMENTS

| | | | |
|---|---|---|---|
| 775135 | 5/1957 | United Kingdom | 15/119.2 |

OTHER PUBLICATIONS

Rubbermaid Cleaning and Maintenance Products Catalog, p. 28 (1995); U.S. Highway 13, Greenville, North Carolina.

Rubbermaid Incorporated Catalog Sheet, 1 page, (1992); 1147 Akron Road, Wooster, Ohio.

*Primary Examiner*—Gary K. Graham

*Attorney, Agent, or Firm*—Renner, Kenner, Greive, Bobak, Taylor & Weber

[57] ABSTRACT

A mop for use on a surface to be cleaned includes a handle and a mop head attached to one end of the handle. A pair of parallel, spaced apart, uniquely-shaped rollers are rotatably mounted on the mop head. Each roller has an essentially round first surface and an essentially flat second surface extending tangently from the first surface. A sponge material is interposed and selectively movable between the first surfaces of the pair of rollers and includes a tip for contacting the surface to be cleaned. The first and second surfaces of the rollers are capable of selectively wringing the sponge material, including the tip, of water.

12 Claims, 6 Drawing Sheets

CAM-SHAPED ROLLER MOP

TECHNICAL FIELD

This invention relates to mops, and more particularly, to wringer mops of the type which utilize rollers attached to the mop head to squeeze or otherwise wring the sponge or other material of water or other liquids. Specifically, this invention relates to a wringer mop having cam-shaped rollers which are more easily manufactured than the prior art round-shaped rollers and provide more effective wringing of the sponge, particularly the tip thereof.

BACKGROUND OF THE INVENTION

Wringer mops that utilize rollers are well known in the prior art. Typically, the known wringer mops comprise a mop head connected to the end of a handle. The mop head has a pair of parallel rows of round-shaped rollers spaced apart from one another. A draw bar or other like mechanism works in cooperation with the handle and is operatively connected at one end in a manner well known in the art to the sponge material generally located between and over the rollers. More particularly, the draw bar passes through the handle and extends within the mop head between the rollers. To wring the sponge material of water or the like, the user manipulates the draw bar in conjunction with the handle to cause the draw bar to move or pull the sponge material between the parallel rows of rotating rollers, thereby squeezing the sponge material and wringing the water therefrom.

However, existing wringer mops, also known as roller mops, do not operate to wring the sponge material completely of water. That is, current designs, such as those shown in U.S. Pat. No. 4,604,767 (FIG. 3) and U.S. Pat. No. 5,655,248 (FIG. 7B), must necessarily stop short of pulling the sponge material all of the way through the rollers because the sponge material could then easily expand or flair within the spacing beneath the rollers and the mop head and would be extremely difficult to push back out between the rollers. Thus, at least the tip of the sponge material, and notably that portion of the sponge material which most often contacts the floor and dirt thereon, is not effectively wrung out. For purposes of this application, the "tip" of the sponge material will refer to that outermost portion of the sponge material which contacts the floor during the normal course of use and would otherwise not be pulled between the opposed rollers of a round-shaped roller mop.

The rotating rollers of the wringer mops of the prior art are generally manufactured in one of two ways. The first, more preferred, method uses a preferably metal center shaft having three larger diameter preferably plastic rollers mounted in a row thereon. The mop head is attached to the preferably metal center shaft at the two spaces in between the three rollers where the shaft is exposed. The other method of manufacture involves molding a one piece roller of large diameter with smaller diameter spacings molded therein for attaching the mop head thereto. Although this second method reduces the number of parts and complexity in assembling the mop, several problems exist with molding the part. For example, the completely solid, large diameter rollers are not only more expensive to manufacture but also require much more plastic. Furthermore, because the rollers use such a large mass of plastic, the manufacturing operation involves much longer molding cycles and, sometimes, even requires additional operational steps, such as dropping the plastic parts into a chilled water bath. Notwithstanding the foregoing manufacturing problems, the parts themselves may be subject to warping which would then cause the sponge material to wring unevenly.

Coring out material on a particular side of a part to reduce its weight and cycle time is generally known in the injection molding art. However, in the case of the round-shaped rollers, it is impossible to core out any of the round-shaped rollers of the prior art since there is no way to prevent the roller from rotating completely, and therefore, a cored out area will have just as likely a chance of being presented against the sponge material as the non-cored out area. Of course, it will be appreciated that the cored out area could not be used to apply pressure to the sponge material in wringing the mop. The cored out area would also undesirably provide a reservoir for water or other liquid from the sponge material into which to be squeezed.

Wringer mops of the type described hereinabove are considered useful for cleaning surfaces such as floors, but are not considered effective for cleaning transparent surfaces such as windows and the like. To that end, many roller mops now often include an attached squeegee, scrubber or other form of wiper or pad suitable for removing cleaning fluid, stains or the like from a cleaning surface. The wiper or pad can be separately attached to the mop handle and manipulated by the user as desired, or can be attached to the rollers such that, as the sponge material is drawn between the rollers, the wiper or pad extends forward to a position suitable for use. U.S. Pat. Nos. 5,655,248 and 4,604,767 show two exemplary methods for attaching the wiper or pad to the rollers such that as the sponge material is pulled between the rollers, the wiper or pad is extended to effectively clean or wipe the surface.

Thus, the need exists for an effective means for more thoroughly wringing a roller mop, including the tip of the sponge material, while improving manufacturability and cost.

SUMMARY OF INVENTION

It is therefore, an object of the present invention to provide a wringer mop of the type which utilizes rollers to wring the mop.

It is another object of the present invention to provide a wringer mop, as above, having rollers which wring the sponge material, including the tip of the sponge material.

It is yet another object of the present invention to provide a wringer mop, as above, which is easier to manufacture, reduces part weight and molding cycle time, and resists warpage.

It is still another object of the present invention to provide a wringer mop, as above, wherein the rollers can be molded as one piece.

It is yet another object of the present invention to provide a wringer mop, as above, having a preferably wiper or pad integrally attached to one of the roller thereof which extends for use upon retracting the sponge material into the space between the rollers.

These and other objects of the present invention, as well as the advantages thereof over the known art relating to wringer mops, which shall become apparent from the description to follow, are accomplished by the invention hereinafter described and claimed.

In general, a mop suitable for use on a surface to be cleaned and made in accordance with the present invention includes a handle and a mop head attached to one end of the handle. A pair of parallel, spaced apart rollers are rotatably mounted on the mop head, with each roller having an essentially round first surface and an essentially flat second surface extending tangently from the round, first surface. A sponge material is at least partially interposed and selectively movable between the first surfaces of the pair of rollers, and has a tip for contacting the surface to be cleaned. Upon rotating the rollers as the sponge material is moved therebetween, the first and second surfaces of said rollers selectively wringing the sponge material, including the tip, of water.

A preferred exemplary wringer mop incorporating the concepts of the present invention is shown by way of example in the accompanying drawings without attempting to show all the various forms and modifications in which the invention might by embodied, the invention being measured by the appended claims and not by the details of the specification.

PREFERRED EMBODIMENT FOR CARRYING OUT THE INVENTION

Figure 1:
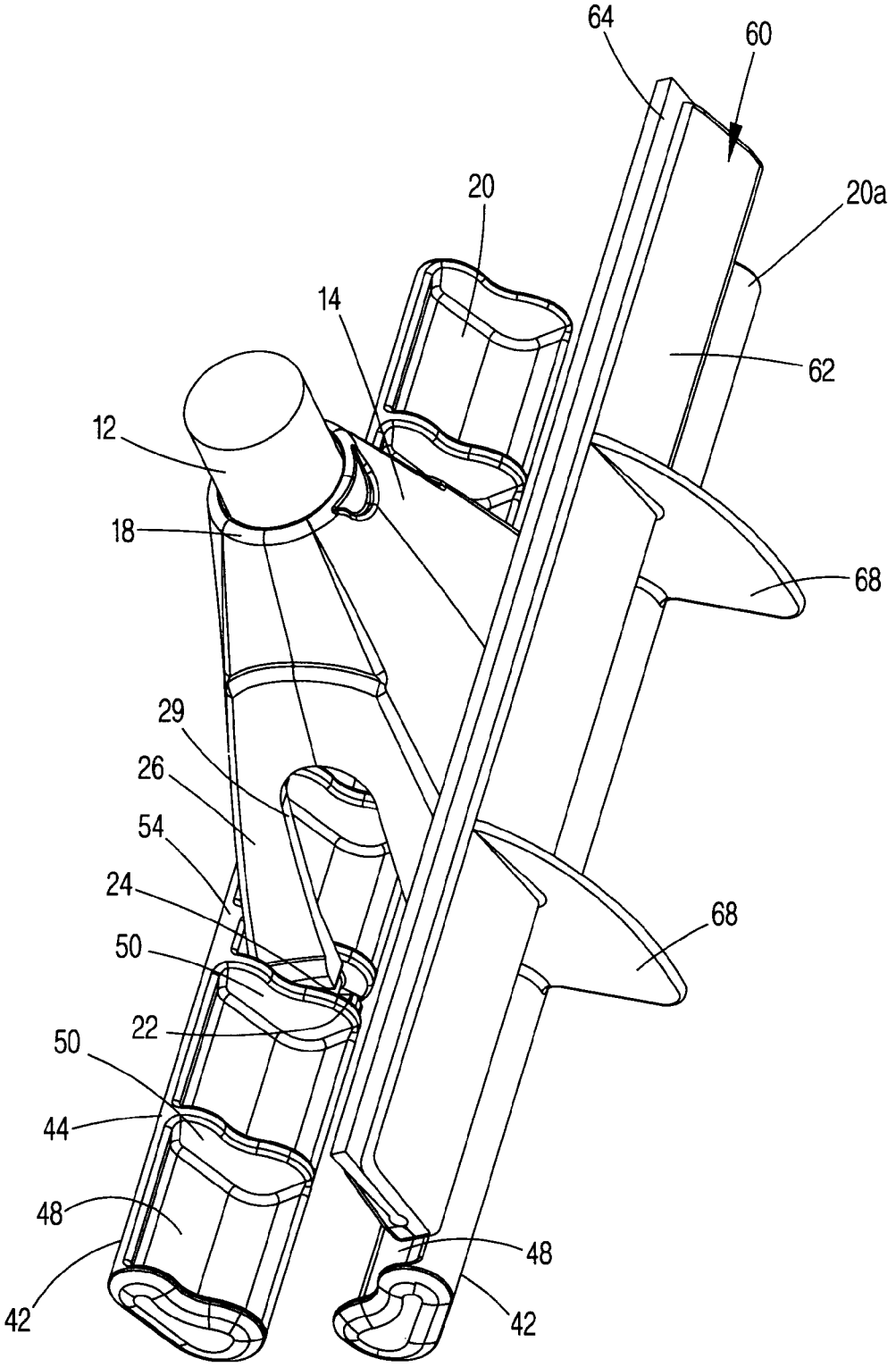
FIG. 1 is a perspective view of a portion of a mop made in accordance with the present invention showing a mop head rotatably mounted to a pair of rollers, one of the rollers having a wiper connected thereto, the wiper being shown in the retracted, not-in-use position.
Figure 2:
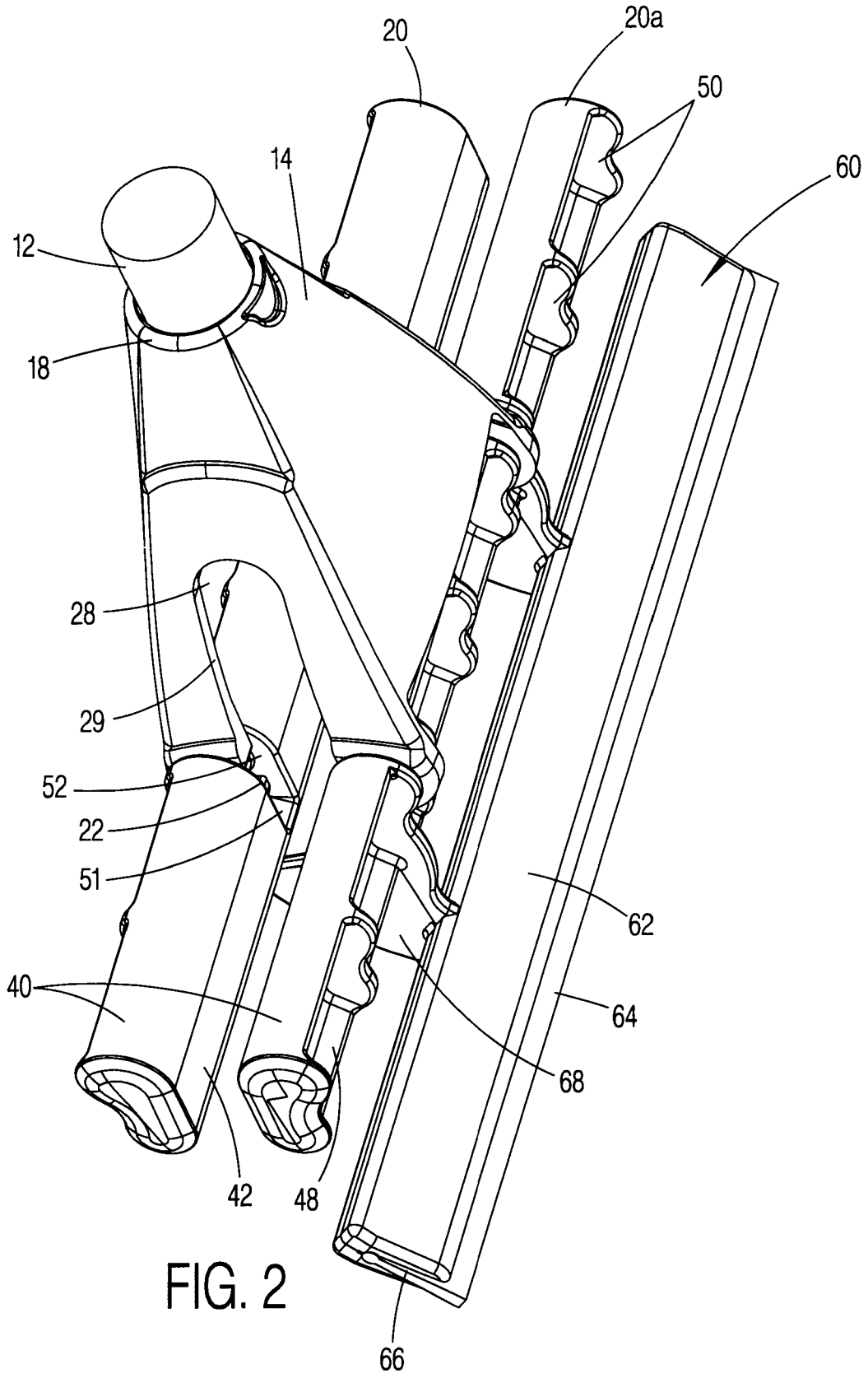
FIG. 2 is a perspective view of the same portion of the mop of FIG. 1 showing the wiper connected to one of the rollers in the extended, for-use position.
Figure 3:
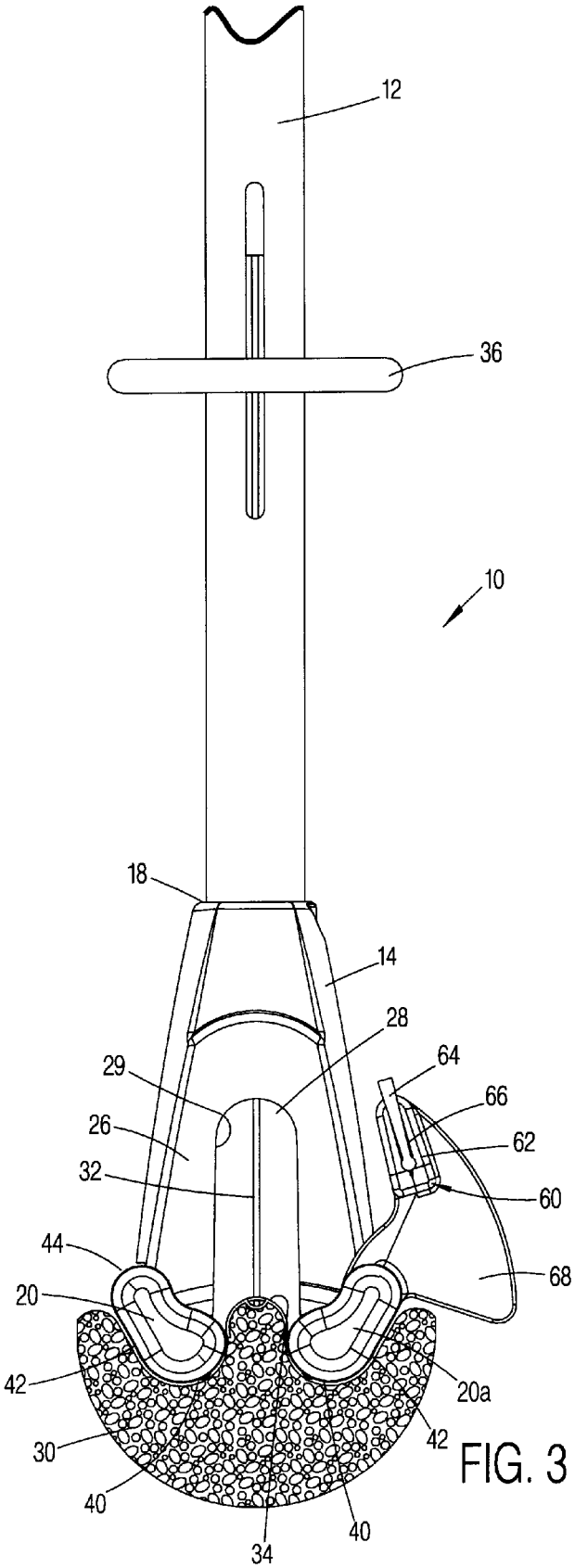
FIG. 3 is a side elevational view of a roller mop made in accordance with the concepts of the present invention with a portion of the handle broken away and shown in the sponge-open, ready-for-cleaning position.
Figure 4:
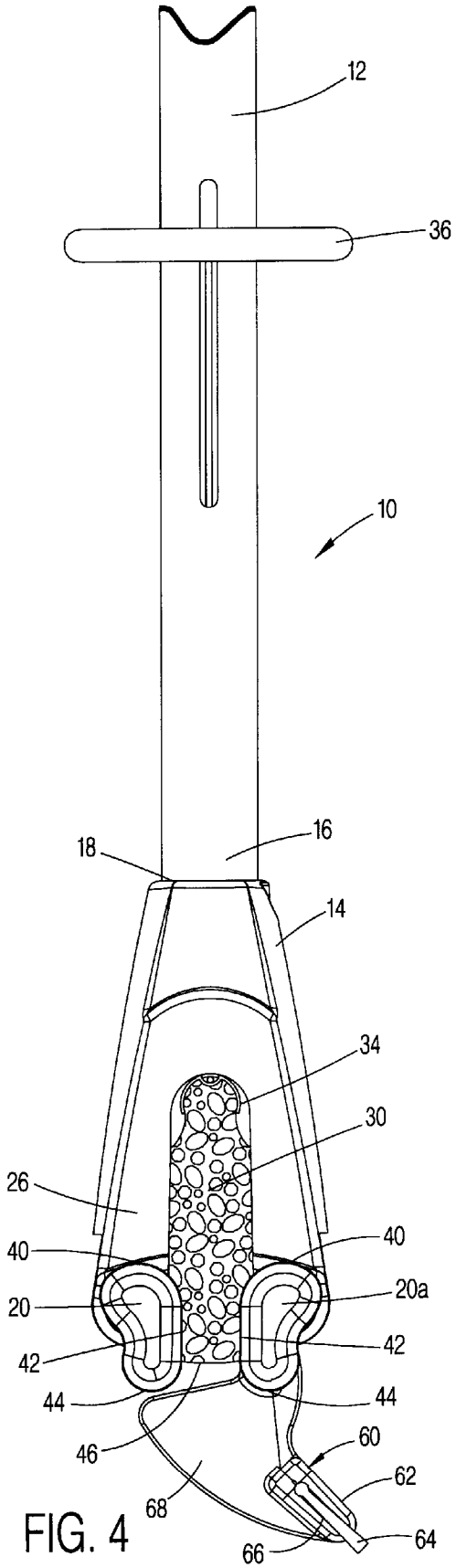
FIG. 4 is a side elevational view of the roller mop of FIG. 3 with a portion of the handle broken away and shown in the sponge-retracted, wringing position.

One representative embodiment of a mop made in accordance with the concepts of the present invention is indicated generally by the numeral 10 in FIGS. 3 and 4. Mop 10 includes a handle 12 and a mop head 14 attached to one end 16 of handle 12 as by any means generally known in the art as at neck 18 of mop head 14. As best shown in FIGS. 1 and 2, a pair of generally parallel, spaced apart, uniquely shaped rollers 20, 20A are rotatably connected to mop head 14, preferably distal from handle 12. More particularly, with respect to the preferred embodiment, mop head 14 may include a plurality of C-shaped, finger-like projections 22 which snap over or are otherwise mounted on small diameter cylinders 24 (best seen in FIG. 5) formed in rollers 20 and 20A to rotatably connect rollers 20 and 20A to mop head 14. The finger-like projections 22 preferably extend from extension members 26 formed as part of mop head 14 so as to create an area or space 28 in mop head 14, particularly defined by edge surface 29, for operatively receiving a sponge material 30 as set forth hereinbelow.

As shown in FIGS. 3 and 4, sponge material 30 is interposed and selectively movable between rollers 20 and 20A. A draw bar 32 or other like mechanism may be operatively connected at one end to sponge material 30 by any means known in the art such as by metal bracket 34 fixedly attached to sponge material 30 as shown in FIG. 3. In the preferred embodiment, draw bar 32 extends through mop head 14 and handle 12 and is operatively connected to a lever 36 located on handle 12 which may be manipulated by the user as known in the art. In the preferred embodiment shown, in order to move sponge material 30 to the sponge-retracted wringing position, lever 36 may be manipulated upward with respect to handle 12 by the user to move the draw bar 32 into mop head 14, thereby drawing or retracting sponge material 30 between rollers 20 and 20A as shown in FIG. 4 and wringing any water which may be present in sponge material 30 therefrom. Conversely, in order to reposition sponge material 30 to the sponge-open, ready-for-cleaning position, lever 36 is moved downward, thereby moving sponge material 30 out of space 28 over rollers 20 and 20A. Sponge material 30 then flares out for use in cleaning surfaces. It will be appreciated that other means for retracting, moving, or manipulating sponge material 30 between rollers 20 and 20A can be substituted for draw bar 32 and lever 36, the scope of the invention being limited only by the subject claims.

It will also be appreciated that, while drawing sponge material 30 between rollers 20 and 20A, rollers 20 and 20A contact or squeeze sponge material 30 and naturally rotate is opposite directions, thereby squeezing or wringing any water or liquid which may be present from sponge material 30. In particular, rollers 20 and 20A have two geometric surfaces 40 and 42 which make contact with sponge material 30 during wringing. One surface 40 is generally round which permits rollers 20 and 20A to rotate as necessary and to provide the necessary compression force against sponge material 30 as it is pulled or retracted into space 28 between rollers 20 and 20A. This surface 40 acts in the same manner as the round-shaped rollers on existing wringer mops. However, there is also a second, generally flat surface 42 to each roller 20, 20A which extends tangently from the rounded surface 40 and provides a longer surface area for fully wringing sponge material 30. As best shown in FIG. 4, upon fully retracting sponge material 30 into space 28, rollers 20 and 20A are rotated such that their elongated ends 44, defined generally by the end of flat surface 42, extend beyond the tip 46 of sponge material 30, thereby assuring that sponge material 30, including tip 46, is squeezed or wrung of water or other liquid. Thus, round surface 40 and flat surface 42 act together to wring sponge material 30, including tip 46 of water.

With particular reference to rollers 20 and 20A, it will be appreciated that each roller 20, 20A requires a generally rounded surface 40 and a generally flat surface 42 as set forth hereinabove. However, the shape or configuration of any of the other surfaces of rollers 20 and 20A may take any form known in the art. Preferably, rollers 20 and 20A include a cored out area 48 and do not include a continuation of surfaces 40 and 42, i.e., a back surface area, inasmuch as they are not required and will not be utilized during operation of mop 10. By "cored out area", it is meant that the roller does not have a continuation of rounded or flat surfaces around its perimeter for essentially the entire length of rollers 20, 20A, but rather is hollow. The term does not particularly pertain to coring material already present upon molding, but rather, the material may be eliminated by virtue of the molding process itself. Rollers 20 and 20A may, however, include support ribs such as 50 to provide strength to the rollers. In the preferred embodiment shown, ribs 50 of rollers 20 and 20A are generally cam-shaped, and therefore, the rollers may be referred to as cam-shaped. Because of the lack of a back surface area, replaced by cored out area 48, rollers 20, 20A can be more easily manufactured, preferably by injection molded in one piece.

Figure 5:
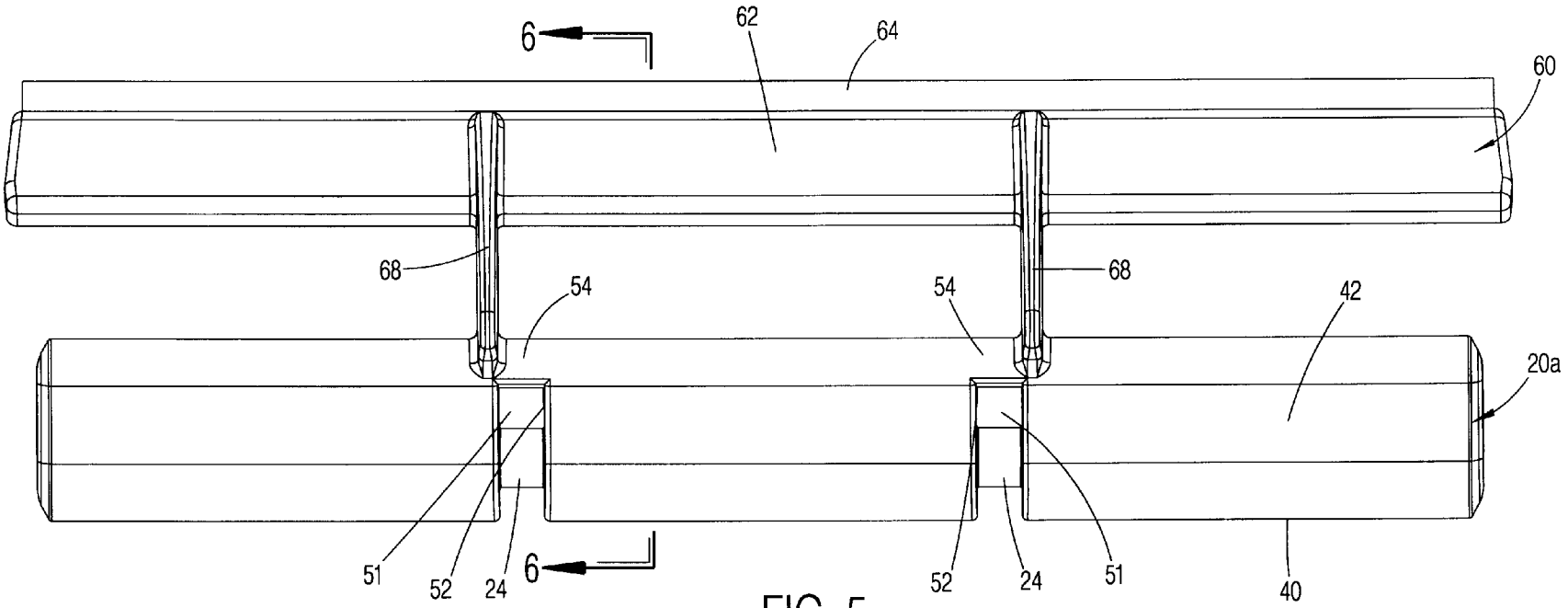
FIG. 5 is a rear elevational view of a roller for a mop having a wiper connected thereto.
Figure 6:
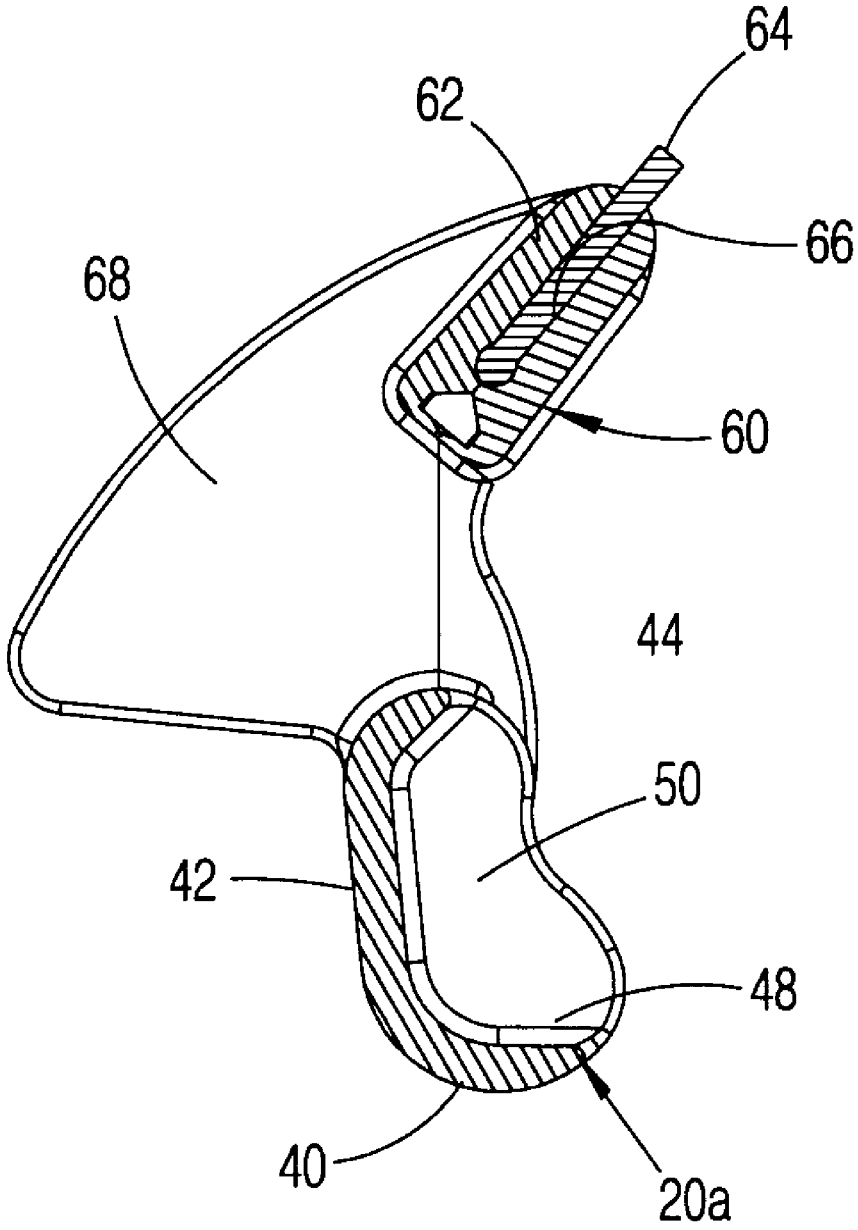
FIG. 6 is a cross-sectional view of the roller of FIG. 5 taken along line 6—6 in FIG. 5.

While the round and flat surfaces 40 and 42, respectively, of rollers 20 and 20A extend essentially the entire length of rollers 20 and 20A, there are gaps 51 defined by walls 52 (as best seen in FIG. 5) in at least the round surfaces 40 thereof where small diameter cylinders 24 are provided for attaching rollers 20 and 20A to mop head 14. The gaps 51 provide the appearance of distinct segmented areas to rollers 20 and 20A. Unlike other mops, however, there is a bridge 54 above each small diameter cylinder 24 which serves to further connect the segmented areas of rollers 20, 20A. Each bridge 54 provides added strength to rollers 20, 20A and helps the part to resist being warped. Bridges 54 allow at least a portion of flat surface 42 to extend uninterrupted for the entire length of rollers 20, 20A.

In addition, as best shown in FIG. 1, each bridge 54 serves as a stop against mop head 14 and prevents rollers 20 and 20A from over rotating or becoming out of position, particularly when rollers 20 and 20A are rotated such that sponge material 30 is in the sponge open, ready-for-cleaning position. As shown in FIG. 4, rollers 20 and 20A are prevented from over rotating the other direction when sponge material 30 is in the sponge-retracted, wringing position by the depth of space 28 defined by edges 29 in extension members 26 of mop head 14 and by the draw bar 32 or lever 36 contacting handle 12 or mop head 14 to the extent that the draw bar 32 cannot be manipulated further into mop head 14.

The limitation of rotation of rollers 20 and 20A further permits rollers 20 and 20A to not be affected by cored out area 48. Because cored out area 48 of rollers 20 and 20A never contact sponge material 30, no water gets forced out into this cored out area of rollers 20 or 20A. The cored out area 48 improves greatly the manufacturing of the rollers by lowering the cycle time during molding of the part since it is a thin walled part rather than a solid mass part. Moreover, because the part is cored, it can be cooled during the molding cycle and does not require dropping rollers 20 or 20A into a chilled water bath, thereby saving time and expense.

In a preferred embodiment, a wiper or other cleaning attachment, generally indicated by the numeral 60, may be mounted on one or more of the rollers, such as roller 20A. Wiper 60 may be removably or fixedly connected to roller 20A, but in the preferred embodiment shown in the drawings, is integrally molded as part of roller 20A.

Wiper 60 generally includes a preferably elongated body portion 62 that securely holds and supports a similarly elongated, flexible wiper blade 64. In the present instance, wiper blade 64 is made of rubber. Body portion 62 is preferably made of one-piece constructions having a slot 66 for receiving wiper blade 64.

Wiper 60 may be removably or fixedly attached to roller 20A by any means known in the art suitable for attaching wiper 60 is a manner suitable for the purposed described herein. In the preferred embodiment, one or more connecting fins 68 integrally connect wiper 60 to roller 20A such that wiper 60 is generally parallel with roller 20A. Each fin 68 is preferably connected to roller 20A at one of ribs 50 located within cored out area 48.

Thus, in operation, it will be appreciated that, as roller 20A is rotated from the sponge-relaxed, ready-for-cleaning position to the sponge-retracted position, wiper 60, in turn, is extended from its retracted, not-in-use position (FIG. 1) to an extended, ready-for-use position. As best shown in FIG. 4, in its extended position, wiper 60 also limits the rotation of roller 20A when fin 68 contacts roller 20 at end 44. This limitation on rotation further prevents rollers 20 and 20A from over rotating.

Thus it should be evident that the mop of the present invention is highly effective in wringing water or other liquid from the entire sponge material, including the tip. The invention is particularly suited for mops having wiper attachments, but is not necessarily limited thereto, the rollers being suitable for practically any roller mop or wringer mop utilizing rollers attached to the mop head to squeeze or otherwise wring the sponge material of water or other liquids.

Based upon the foregoing disclosure, it should now be apparent that a mop constructed in accordance with the concepts of the present invention, as described herein, accomplishes the objects of the present invention and otherwise substantially improves the art. It is, therefore, to be understood that any variations evident fall within the scope of the claimed invention and thus, the selection of specific structural elements can be determined without departing from the spirit of the invention herein disclosed and described. In particular, attachments, if any, to the rollers in accordance with the embodiment of the present invention are not necessarily limited to those having a wiper. For example, scrubber pads and other cleaning items may easily be substituted therefor. Moreover, as noted hereinabove, other means for retracting, moving, or otherwise manipulating the sponge material between the rollers can be substituted for the draw bar 32 shown in FIGS. 3 and 4. Thus, the scope of the invention shall include all modifications and variations that may fall within the scope of the attached claims.

What is claimed is:

1. A mop for use on a surface to be cleaned comprising:

a handle;

a mop head attached to one end of said handle;

a pair of parallel, spaced apart rollers rotatably mounted on said mop head, each said roller having an essentially round first surface, an essentially flat second surface extending tangently from said first surface, a hollow, cored out area opposite said first and second surfaces and defined by said first and second surfaces, and a plurality of ribs within said cored out area to strengthen said rollers; and a sponge material interposed and selectively movable between said first surfaces of said pair of rollers, said sponge material having a tip for contacting the surface to be cleaned, said first and second surfaces of said rollers capable of selectively wringing said sponge material, including said tip, of water.

2. The mop according to claim 1, further comprising a mechanism having one end cooperating with said handle and an opposite end connected to said sponge material between said rollers opposite said tip, whereby said sponge material is selectively movable between said rollers upon manipulation of said mechanism with said handle.

3. The mop according to claim 1, wherein said plurality of ribs are cam-shaped.

4. The mop according to claim 1, wherein said first and second surfaces of said rollers include gaps having cylinders therein for receiving said mop head.

5. The mop according to claim 4, wherein said rollers includes a bridge over each gap in said rollers such that a portion of said second surface extends uninterrupted for the entire length of said rollers.

6. The mop according to claim 1, further comprising a cleaning attachment connected to at least one of said rollers.

7. The mop according to claim 6, wherein said cleaning attachment is a wiper integrally connected to one of said rollers.

8. The mop according to claim 6, wherein said cleaning attachment is retracted when said sponge material is being used and extends for use when said sponge material is retracted.

9. The mop according to claim 1, wherein said rollers are injection molded as one piece.

10. The mop according to claim 1, wherein said mop head includes a space for receiving said sponge material, and wherein said sponge material is selectively retractable therein.

11. The mop according to claim 1, wherein said roller is cam-shaped.

12. A mop for use on a surface to be cleaned comprising:

a handle;

a mop head attached to one end of said handle;

a pair of parallel, spaced apart rollers rotatably mounted on said mop head, each said roller having an essentially round first surface and an essentially flat second surface extending tangently from said first surface;

a sponge material interposed and selectively movable between said first surfaces of said pair of rollers, said sponge material having a tip for contacting the surface to be cleaned, said first and second surfaces of said rollers capable of selectively wringing said sponge material, including said tip, of water; and a cleaning attachment capable of being extended for use on the surface to be cleaned and connected to at least one of said rollers by a connecting fin extending outwardly such that, when said cleaning attachment is extended, said connecting fin contacts the other of said rollers.

* * * * *